US011041268B2

(12) United States Patent
Huang et al.

(10) Patent No.: US 11,041,268 B2
(45) Date of Patent: Jun. 22, 2021

(54) ANTI-OVERFLOW DEVICE AT DRUM WATER INJECTION PORT AND DRUM WASHING MACHINE

(71) Applicant: QINGDAO HAIER WASHING MACHINE CO., LTD., Shandong (CN)

(72) Inventors: Bencai Huang, Shandong (CN); Qidui Liang, Shandong (CN); Jingde Li, Shandong (CN)

(73) Assignee: QINGDAO HAIER WASHING MACHINE CO., LTD., Shandong (CN)

( * ) Notice: Subject to any disclaimer, the term of this patent is extended or adjusted under 35 U.S.C. 154(b) by 141 days.

(21) Appl. No.: 16/345,961

(22) PCT Filed: Nov. 1, 2017

(86) PCT No.: PCT/CN2017/108933

§ 371 (c)(1),
(2) Date: Apr. 29, 2019

(87) PCT Pub. No.: WO2018/082564

PCT Pub. Date: May 11, 2018

(65) Prior Publication Data

US 2020/0063324 A1 Feb. 27, 2020

(30) Foreign Application Priority Data

Nov. 1, 2016 (CN) ..... 201610935852.9

(51) Int. Cl.
*D06F 39/08* (2006.01)
*D06F 37/26* (2006.01)

(52) U.S. Cl.
CPC ..... *D06F 39/081* (2013.01); *D06F 37/267* (2013.01); *D06F 39/088* (2013.01)

(58) Field of Classification Search
CPC .... D06F 39/081; D06F 37/267; D06F 39/088; D06F 39/08
See application file for complete search history.

(56) References Cited

U.S. PATENT DOCUMENTS

2005/0204479 A1 9/2005 Strait
2006/0094254 A1 5/2006 Chang et al.
(Continued)

FOREIGN PATENT DOCUMENTS

CN 201056641 Y * 5/2008
CN 201738144 U 2/2011
(Continued)

OTHER PUBLICATIONS

International Search Report (PCT/ISA/210) dated Jan. 29, 2018, by the Chinese Patent Office as the International Searching Authority for International Application No. PCT/CN2017/108933.

*Primary Examiner* — Michael E Barr
*Assistant Examiner* — Pallavi Chitta
(74) *Attorney, Agent, or Firm* — Buchanan Ingersoll & Rooney PC

(57) ABSTRACT

An anti-overflow device at a drum water injection port for a drum washing machine comprises a water flow baffle. The water flow baffle extends along an outer drum to an inner drum and is installed at the water injection port, and water flow is blocked to run back into the water injection port along with the inner drum at a high speed. The anti-overflow device further comprises a blocking rib, and the blocking rib is arranged on the inner side of the water injection port and close to the outer drum. The drum washing machine comprises the anti-overflow device at the drum water injection port. The principle of fluid mechanics is adopted in the
(Continued)

anti-overflow device at the drum water injection port, the change of liquid flow in the drum is realized, and the anti-overflow effect is good.

15 Claims, 6 Drawing Sheets

(56) References Cited

U.S. PATENT DOCUMENTS

| | | | | |
|---|---|---|---|---|
| 2006/0162393 | A1* | 7/2006 | Kwon | D06F 39/028 68/17 R |
| 2009/0228727 | A1 | 9/2009 | Tamura et al. | |
| 2010/0064444 | A1 | 3/2010 | Nieh et al. | |

FOREIGN PATENT DOCUMENTS

| | | | | |
|---|---|---|---|---|
| CN | 102505424 | A | | 6/2012 |
| CN | 104074032 | A | | 10/2014 |
| CN | 104878569 | A | * | 9/2015 |
| CN | 205062498 | U | | 3/2016 |

* cited by examiner

ANTI-OVERFLOW DEVICE AT DRUM WATER INJECTION PORT AND DRUM WASHING MACHINE

TECHNICAL FIELD

The disclosure relates to an anti-overflow device at a drum water injection port and a drum washing machine, in particular to an anti-overflow device at a drum water injection port and a drum washing machine for preventing, guided by the principle of fluid mechanics, water and foam in a washing drum from flowing back through the water injection port.

BACKGROUND

Too much foam will be produced in the washing process of the existing drum washing machine if a lot of detergent is used or not too dirty clothes are washed, and the foam filled inside the drum will increase the pressure inside the drum, and more foam will be produced in the subsequent washing process as a result of the rotation of the washing drum. Space deficiency within the washing drum will lead to the overflow of fluid (composed mainly of the foam and the water containing the detergent and sewage), and the fluid in the drum washing machine usually overflows from the sink, bringing pollution to environment and great inconvenience to users.

At the same time, in the washing or dehydration process of the drum washing machine, the water in the drum will agitate with the rotation of the drum, or the high-speed water will be thrown from the inner drum to the inner wall of the outer drum and flow along the outer drum wall. In addition, with the vibration of the drum, the water will overflow from the water injection port. Overflow will occur if there is water injection. The overflow of water from the sink brings pollution to the environment and great inconvenience to users.

At present, there are two main solutions to this situation, one is to adjust the computer program and the other is to add the anti-overflow structure.

The adjustment in the computer program can reduce the occurrence of foam or overflow by changing the rotation speed, adjusting the water injection and drainage time, and the rotation-stop ratio. However, the change in the program is limited by the energy efficiency and water consumption performance, and it cannot eradicate the occurrence of foam and water overflow. Therefore, structural changes are often needed to achieve the goal.

The Chinese patent application with the application number 201520796673.2 discloses a washing machine's water inlet pipe component and washing machine, wherein the washing machine's water inlet pipe component includes an inlet pipe and a valve clack provided in the inlet pipe, the inlet pipe includes a body, a water inlet connector and a water outlet connector, and the water inlet connector and the water outlet connector are provided respectively at both ends of the body and the valve clack is adjacent to the water outlet connector; and the edge remaining part of the valve clack is in clearance fit with the inner wall of the body. This technical structure needs to add the valve clack in the original water inlet pipe. The increase of structure reduces the reliability of the whole machine, which may lead to defects such as defective parts, incomplete assembly and aging failure in the process of use. In addition, the increase of components will increase the production assembly cost.

The Chinese patent application with the application number 201110320633.7 discloses a foam overflowing prevention drum washing machine. The foam overflowing prevention drum washing machine comprises a water inlet device, a drum and a water inlet connecting pipe, wherein the water inlet device is connected with the drum through the water inlet connecting pipe, an overflowing prevention one-way valve is arranged at the water inlet connecting pipe, the one-way valve is arranged at the part of the water inlet connecting pipe near the drum. The overflowing prevention one-way valve comprises a sealing sheet, the sealing sheet is rotatablely arranged on the pipe wall of the water inlet connecting pipe, the water inlet connecting pipe is provided with a baffle plate at the opposite side of the sealing sheet, and the sealing sheet is in lap joint with the baffle plate. This technical structure needs to add the sealing sheet and a baffle plate in the original water inlet connecting pipe. The increase of structure reduces the reliability of the whole machine, which may lead to defects such as defective parts, incomplete assembly and aging failure in the process of use. In addition, the increase of components will increase the cost and the difficulty of assembly. Besides, the vibration frequency of the one-way sealing sheet will also decrease under the low-frequency vibration of the drum rotation, and the probability of water and foam overflow will also increase.

In view of this, the present disclosure is hereby presented.

SUMMARY

The technical problem to be solved by the disclosure is to overcome the shortcomings of the prior art and to provide an anti-overflow device at a drum water injection port and a drum washing machine for preventing, guided by the principle of fluid mechanics, water and foam in a washing drum from flowing back through the water injection port.

In order to solve the above technical problems, the basic conception of the technical solution adopted in the disclosure is: an anti-overflow device at a drum water injection port, wherein the anti-overflow device comprises a water flow baffle, the water flow baffle is installed at the water injection port and extends along an outer drum to an inner drum, and water flow is blocked by the water flow baffle to run back into the water injection port along with the inner drum at a high speed. According to the principle of fluid mechanics, when the fluid passes through the water flow baffle, the fluid is shunted to bypass the water injection port and flows slower in the area of the water injection port to prevent overflow.

Further, the ratio L/H of the length L of the water flow baffle inserted into the outer drum and the distance H between the inner and outer drums at the water injection port is greater than 0 and less than 1, preferably between 0.3 and 0.85.

Further, the water flow baffle is in the shape of a flat plate, a curved plate or a prismatic plate. Compared with the flat plate, the fluid is gently shunted when the fluid flows through the curved plate or the prismatic plate, and thus has a better anti-overflow effect. Hence, the water flow baffle is in the shape of a curved plate or a prismatic plate. Preferably, the water flow baffle is in the shape of a curved plate to match the shape of the injection port.

Further, the water flow baffle and the water injection end of the water injection hose are in an integrated structure. Preferably, the water flow baffle is a curved plate that extends from the inner wall of the water injection end to the outside of the hose and matches the water injection port. Further preferably, the inner surface of the water flow baffle and the inner surface of the water injection end have a smooth transition. A pipe clamp is fixed between the water injection end of the water injection hose and the outer drum.

Further, the water flow baffle and the water injection end of the water injection hose are in a split structure. Preferably, the water flow baffle is provided with an integrated connecting pipe, and is fixed on the water injection end by threading connecting pipe into the water injection end. Further preferably, the outer drum is clamped between the water flow baffle and the water injection end. The water flow baffle is a curved plate extending from the inner wall of the connecting pipe and matching the connecting pipe, and the inner surface of the water flow baffle and that of the connecting pipe have a smooth transition.

Further, the anti-overflow device also includes a blocking rib, and the blocking rib is arranged on the inner side of the water injection port and close to the outer drum. And the blocking rib is opposite to the water flow baffle.

Further, the blocking rib is set at an angle to the cross section of the water injection port and inclined toward the outer drum.

Further, the angle between the blocking rib and the water injection direction of the water injection port is between 30°-90°.

Further, the ratio h/d of the vertical chord height h from the blocking rib to the water injection port to the diameter d of the water injection port is greater than 0 and less than 1, preferably between 0.25 and 0.75.

The disclosure also discloses a drum washing machine, including an anti-overflow device at a drum water injection port, wherein the anti-overflow device comprises a water flow baffle, the water flow baffle is installed at the water injection port and extends along an outer drum to an inner drum, and water flow is blocked by the water flow baffle to run back into the water injection port along with the inner drum at a high speed.

An anti-overflow device at a drum water injection port according to the present disclosure, wherein the ratio L/H of the length L of the water flow baffle inserted into the outer drum and the distance H between the inner and outer drums at the water injection port is greater than 0 and less than 1, preferably between 0.3 and 0.85. Further, the water flow baffle is in the shape of a flat plate, a curved plate or a prismatic plate. Compared with the flat plate, the fluid is gently shunted when the fluid flows through the curved plate or the prismatic plate, and thus has a better anti-overflow effect. Hence, the water flow baffle is in the shape of a curved plate or a prismatic plate. Preferably, the water flow baffle is in the shape of a curved plate to match the shape of the water injection port. Further, the water flow baffle and the water injection end of the water injection hose are in an integrated structure. Preferably, the water flow baffle is a curved plate that extends from the inner wall of the water injection end to the outside of the hose and matches the water injection port. Preferably, the inner surface of the water flow baffle and the inner surface of the water injection end have a smooth transition. A pipe clamp is fixed between the water injection end of the water injection hose and the outer drum. Further, the water flow baffle and the water injection end of the water injection hose are in a split structure. Preferably, the water flow baffle is provided with an integrated connecting pipe, and is fixed on the water injection end by threading the connecting pipe into the water injection end. Preferably, the outer drum is clamped between the water flow baffle and the water injection end. The water flow baffle is a curved plate extending from the inner wall of the connecting pipe and matching the connecting pipe, and the inner surface of the water flow baffle and that of the connecting pipe have a smooth transition. Further, the anti-overflow device also includes a blocking rib, and the blocking rib is arranged on the inner side of the water injection port and close to the outer drum. And the blocking rib is opposite to the water flow baffle. Further, the angle between the blocking rib and the water injection direction of the water injection port is between 30°-90°. Further, the ratio h/d of the vertical chord height h from the blocking rib to the water injection port to the diameter d of the water injection port is greater than 0 and less than 1, preferably between 0.25 and 0.75.

After adopting the above technical solution, the disclosure has the following beneficial effects compared with the prior art:

1. The present disclosure adopts the principle of fluid mechanics to realize the change of liquid flow in the drum, with a good anti-overflow effect;

2. The anti-overflow device at the drum water injection port has a simple structure and high reliability;

3. The present disclosure has simple components and good economic efficiency.

The following is a further detailed description of the specific embodiment of the present disclosure on the basis of the attached drawings.

BRIEF DESCRIPTION OF THE DRAWINGS

The drawings are part of the present disclosure and are used to provide a further understanding of the present disclosure. Schematic embodiments of the present disclosure and their descriptions are used to explain the present disclosure, but do not constitute an undue qualification of the present disclosure. Obviously, the attached drawings described below are only some embodiments. For ordinary technicians in this field, other attached drawings can be obtained on the basis of these drawings without any inventive work. In the attached drawings.

Figure 1:
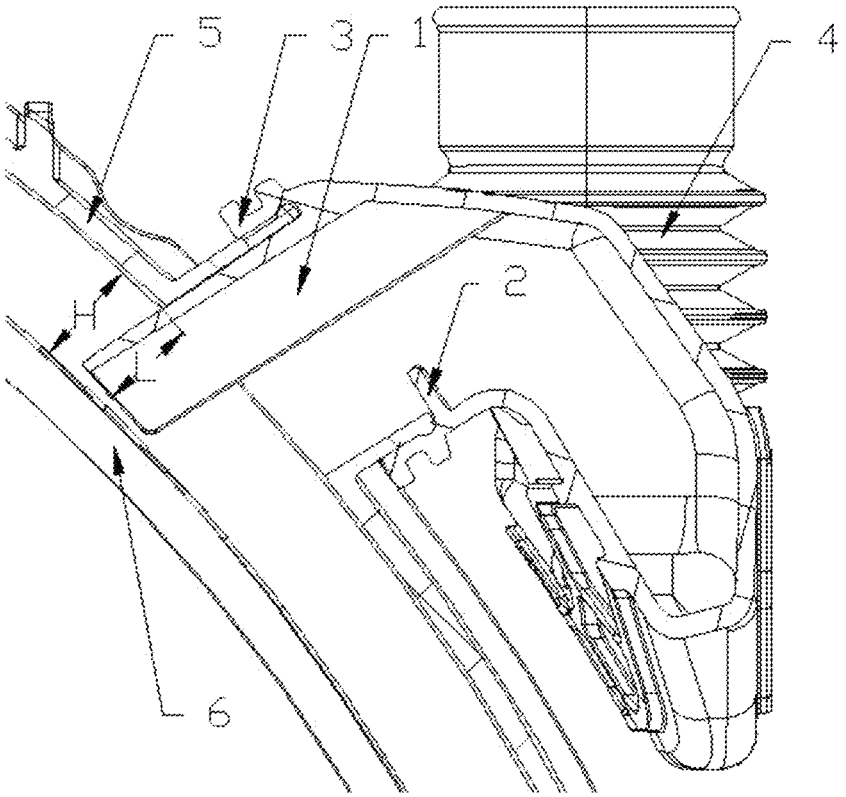
FIG. 1 is a schematic diagram of the position of the anti-overflow device at the drum water injection port of the present disclosure.

In the drawings: 1. water flow baffle; 2. blocking rib; 3. water injection end; 4. water injection hose; 5. outer drum; 6. inner drum; 7. connecting pipe.

It should be noted that these drawings and written descriptions are not intended to limit the scope of the present disclosure in any way, but rather to illustrate the concept of the present disclosure for those skilled in the art by reference to a particular embodiment.

DETAILED DESCRIPTION OF THE EMBODIMENTS

The following is a further introduction of the specific embodiment of the present disclosure combined with the attached drawings.

FIG. 1 to FIG. 5 show an anti-overflow device at a drum water injection port, wherein the anti-overflow device comprises a water flow baffle 1, the water flow baffle 1 is installed at the water injection port and extends along an outer drum 5 to an inner drum 6, and water flow is blocked by the water flow baffle to run back into the water injection port along with the inner drum 6 at a high speed. According to the principle of fluid mechanics, when the fluid passes through the water flow baffle 1, the fluid is shunted to bypass the water injection port and flows slower in the area of the water injection port to prevent overflow.

Further, the ratio L/H of the length L of the water flow baffle 1 inserted into the outer drum and the distance H between the inner and outer drums at the water injection port is greater than 0 and less than 1, preferably between 0.3 and 0.85. Further, the water flow baffle 1 is in the shape of a flat plate, a curved plate or a prismatic plate. Compared with the flat plate, the fluid is gently shunted when the fluid flows through the curved plate or the prismatic plate, and thus has a better anti-overflow effect. Hence, the water flow baffle 1 is in the shape of a curved plate or a prismatic plate. Preferably, the water flow baffle is in the shape of a curved plate to match the water injection port.

The water flow baffle 1 and the water injection end 3 of the water injection hose 4 are in an integrated structure. Preferably, the water flow baffle 1 is a curved plate that extends from the inner wall of the water injection end 3 to the outside of the hose and matches the water injection port. Preferably, the inner surface of the water flow baffle 1 and the inner surface of the water injection end 3 have a smooth transition. A pipe clamp is fixed between the water injection end of the water injection hose and the outer drum. Further, the water flow baffle 1 and the water injection end 3 of the water injection hose 4 are in a split structure. Preferably, the water flow baffle 1 is provided with an integrated connecting pipe 7, and is fixed on the water injection end 3 by threading connecting pipe 7 into the water injection end 3. Further preferably, the outer drum 5 is clamped between the water flow baffle 1 and the water injection end 3. The water flow baffle 1 is a curved plate extending from the inner wall of the connecting pipe 7 and matching the water injection port, and the inner surface of the water flow baffle 1 and that of the connecting pipe 7 have a smooth transition. The maximum straight-line width W of the water flow baffle 1 is greater than or equal to the diameter d of the water injection port. Further, the anti-overflow device also includes a blocking rib 2, and the blocking rib 2 is arranged on the inner side of the water injection port and close to the outer drum 5. And the blocking rib 2 is opposite to the water flow baffle 1. The blocking rib 2 is set at an angle to the cross section of the water injection port and inclined toward the outer drum 5. The angle between the blocking rib 2 and the water injection direction of the water injection port is between 30°-90°. The ratio h/d of the vertical chord height h from the blocking rib 2 to the water injection port to the diameter d of the water injection port is greater than 0 and less than 1, preferably between 0.25 and 0.75.

The disclosure also discloses a drum washing machine, including an anti-overflow device at a drum water injection port.

Embodiment 1

Figure 2:
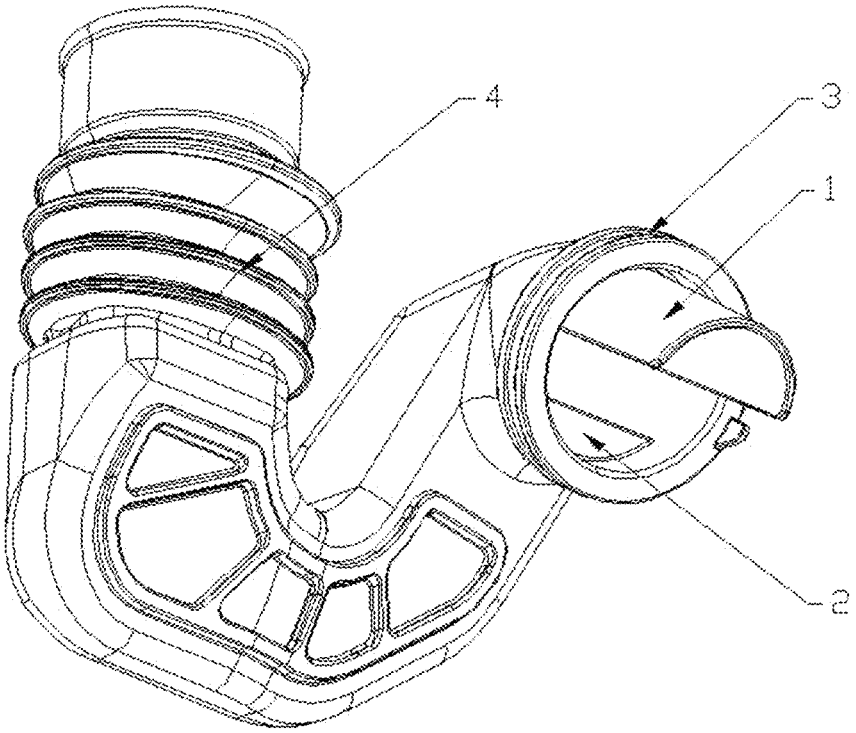
FIG. 2 is a schematic diagram of the anti-overflow device at the drum water injection port of the present disclosure.
Figure 3:
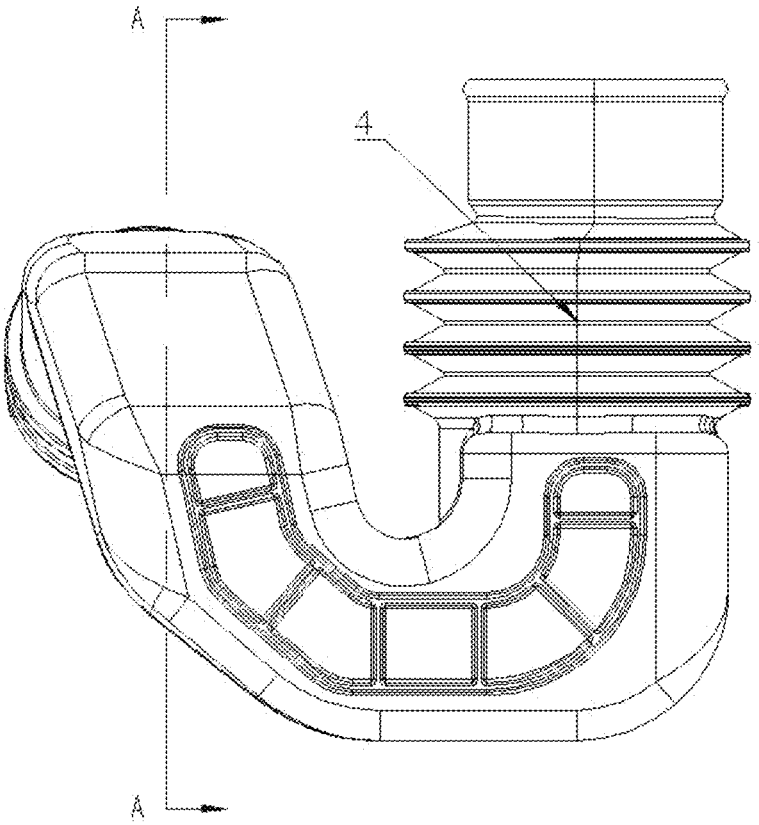
FIG. 3 is the rear view of the anti-overflow device at the drum water injection port of the present disclosure.
Figure 4:
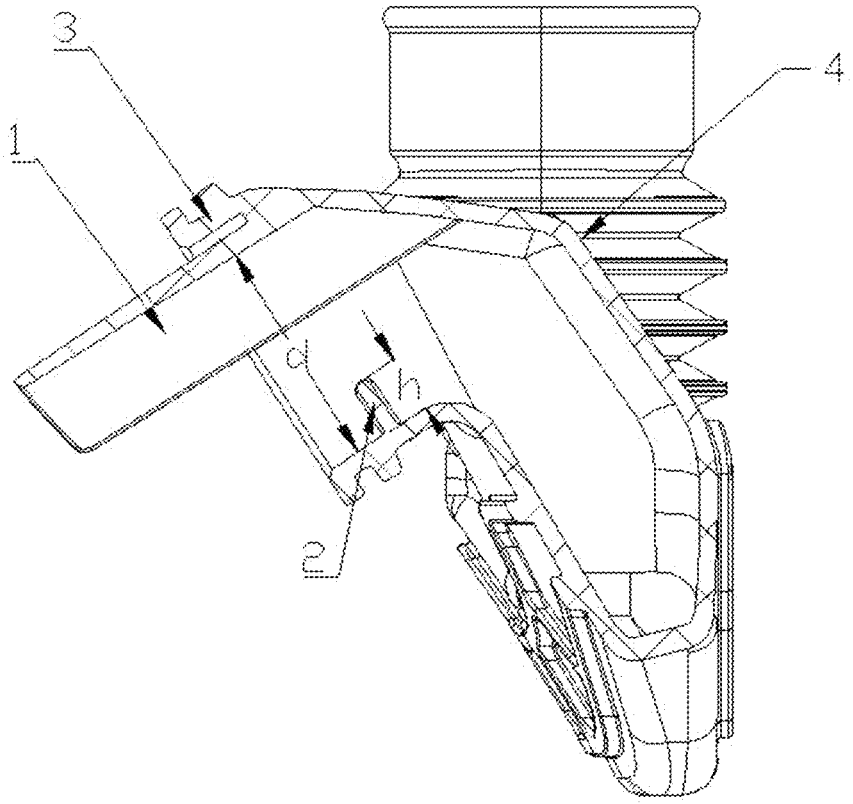
FIG. 4 is an A-A sectional view of the anti-overflow device at the drum water injection port of the present disclosure.

As shown in FIG. 2-4, in the present embodiment, the water flow baffle 1 of the anti-overflow device at the drum water injection port and the water injection end 3 of the water injection hose 4 are in an integrated structure. The present disclosure needs not be used after assembly and has simple components, high reliability and good economic effect.

The water flow baffle 1 is a curved plate that extends from the inner wall of the water injection end 3 to the outside of the hose and matches the water injection port. Preferably, the inner surface of the water flow baffle 1 and the inner surface of the water injection end 3 have a smooth transition. The water flow baffle 1 can also be a curved plate or dog-eared prismatic plate that does not match the water injection port, and this curved plate or dog-eared prismatic plate also has the effect of blocking the flow, and can achieve the best flow blocking effect even when the boundary of the water flow baffle is beyond the diameter of the water injection port. And this water flow baffle is not easily integrated with the water injection end 3 of the water injection hose 4, and is not very convenient to assemble with the outer drum 5. Hence, the curved plate matching with the water injection port is preferred, and generally the external diameter of the water flow baffle 1 is less than or equal to the nominal diameter of the thread at the water injection port.

As shown in FIG. 1, the anti-overflow device comprises a water flow baffle 1, the water flow baffle 1 is installed at the water injection port and extends along an outer drum 5 to an inner drum 6, and water flow is blocked by the water flow baffle to run back into the water injection port along with the inner drum 6 at a high speed. Further, the ratio L/H of the length L of the water flow baffle 1 inserted into the outer drum and the distance H between the inner and outer drums at the water injection port is greater than 0 and less than 1, preferably between 0.3 and 0.85. The maximum straight-line width W of the water flow baffle 1 is greater than or equal to the diameter d of the water injection port.

Figure 6:
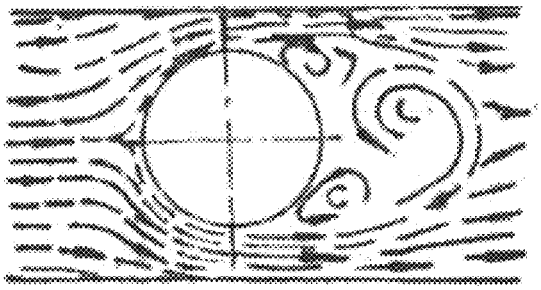
FIG. 6 is a schematic diagram of the anti-overflow principle of the anti-overflow device of the present disclosure.

As shown in FIG. 2, the shape of the water flow baffle 1 is a half-curved plate matching the water injection end. When the fluid in the washing drum flows and meets the water flow baffle 1, as shown in FIG. 6, according to the phenomenon of Karman Vortex Street of the principle of fluid mechanics, the fluid is shunted when it flows through the water flow baffle 1, and forms a stable region with reduced fluidity at the back of the water flow baffle 1 so that the fluid fluidity at the water injection port is reduced. In this condition, the occurrence of water or foam overflow is prevented.

As shown in FIG. 4, the blocking rib 2 is arranged on the inner side of the water injection port and close to the outer drum. And the blocking rib 2 is opposite to the water flow baffle 1. The blocking rib 2 is set at an angle to the cross section of the water injection port and inclined toward the outer drum 5. Further, the angle between the blocking rib 2 and the water injection direction of the water injection port is between 30°-90°. Further, the ratio h/d of the vertical chord height h from the blocking rib 2 to the water injection port to the diameter d of the water injection port is greater than 0 and less than 1, preferably between 0.25 and 0.75. The blocking rib 2 matches the water flow baffle 1 to effectively block the overflow of water and at the same time slow down the flow speed to prevent water or foam overflow.

Embodiment 2

Figure 5:
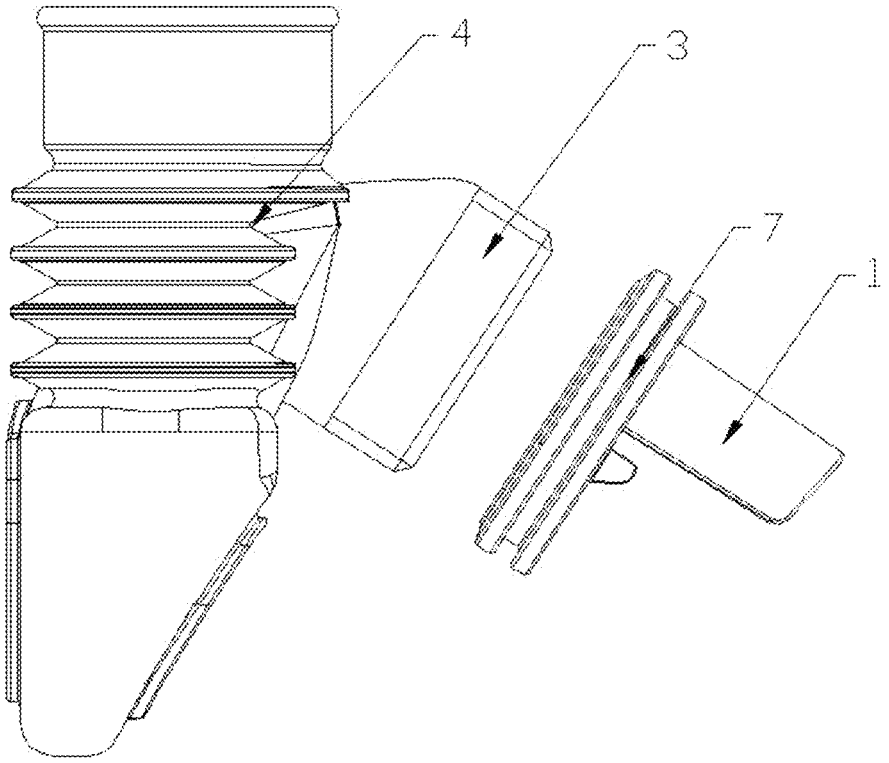
FIG. 5 is a separate schematic diagram of the anti-overflow device at the drum water injection port of the present disclosure.

As shown in FIG. 5, in the present embodiment, and the anti-overflow device at the water injection port and the water injection end 3 of the water injection hose 4 are in a split structure, and they are connected with each other through thread.

The water flow baffle is provided with an integrated connecting pipe 7, and is fixed with the water injection end 3 by threading the connecting pipe 7 into the water injection end 3. Further preferably, the outer drum 5 is clamped between the water flow baffle 1 and the water injection end 3. The water flow baffle 1 is a curved plate extending from the inner wall of the connecting pipe 7 and matching the connecting pipe 7, and the inner surface of the water flow baffle 1 and that of the connecting pipe 7 have a smooth transition. The connecting pipe 7 has been set in the following two means: one end of the connecting pipe 7 is fixed with the water injection end 3 of the water injection hose 4 through thread, and the other end of the connecting pipe 7 is fixed with the water injection hole of the outer drum through thread, preferably the external diameter of the water flow baffle 1 is less than or equal to the nominal diameter of the thread outside of the connecting pipe, and if the external diameter of the water flow baffle 1 is greater than the nominal diameter of the thread outside of the connecting pipe, the connecting pipe cannot be installed; in addition, one end of the connecting pipe 7 passes through the water injection hole of the outer drum 5 and is fixed with the water injection end of the water injection hose 4 through thread. In this case, the external diameter of the water flow baffle 1 is not limited to be less than or equal to the nominal diameter of the thread outside of the connecting pipe, and the water flow baffle with the external diameter slightly larger than the nominal diameter is preferred. The setting of the connecting pipe 7 is preferably the latter of the above mentioned.

As shown in FIG. 1, the anti-overflow device comprises a water flow baffle 1, the water flow baffle 1 is installed at the water injection port and extends along an outer drum 5 to an inner drum 6, and water flow is blocked by the water flow baffle to run back into the water injection port along with the inner drum 6 at a high speed. Further, the ratio L/H of the length L of the water flow baffle 1 inserted into the outer drum and the distance H between the inner and outer drums at the water injection port is greater than 0 and less than 1, preferably between 0.3 and 0.85. The maximum straight-line width W of the water flow baffle 1 is greater than or equal to the diameter d of the water injection port.

As shown in FIG. 2, the shape of the water flow baffle 1 is a half-curved plate matching the water injection port. When the fluid in the washing drum flows and meets the water flow baffle 1, as shown in FIG. 6, according to the phenomenon of Karman Vortex Street of the principle of fluid mechanics, the fluid is shunted when it flows through the water flow baffle 1, and forms a stable region with reduced fluidity at the back of the water flow baffle 1 so that the fluid fluidity at the water injection port is reduced. In this condition, the occurrence of water or foam overflow is prevented.

As shown in FIG. 4, the blocking rib 2 is arranged on the inner side of the water injection port and close to the outer drum. And the blocking rib 2 is opposite to the water flow baffle 1. The blocking rib 2 is set at an angle to the cross section of the water injection port and inclined toward the outer drum 5. Further, the angle between the blocking rib 2 and the water injection direction of the water injection port is between 30°-90°. Further, the ratio h/d of the vertical chord height h from the blocking rib 2 to the water injection port to the diameter d of the water injection port is greater than 0 and less than 1, preferably between 0.25 and 0.75. The blocking rib 2 matches the water flow baffle 1 to effectively block the overflow of water and at the same time slow down the flow speed to prevent water or foam overflow.

Embodiment 3

FIG. 1 to FIG. 5 show in the present embodiment, an anti-overflow device at a drum water injection port, wherein the anti-overflow device comprises a water flow baffle 1, the water flow baffle 1 is installed at the water injection port and extends along an outer drum 5 to an inner drum 6, and water flow is blocked by the water flow baffle to run back into the water injection port along with the inner drum 6 at a high speed. According to the principle of fluid mechanics, when the fluid passes through the water flow baffle 1, the fluid is shunted to bypass the water injection port and flows slower in the area of the water injection port to prevent overflow.

Further, the ratio L/H of the length L of the water flow baffle 1 inserted into the outer drum and the distance H between the inner and outer drums at the water injection port is greater than 0 and less than 1, preferably between 0.3 and 0.85. The maximum straight-line width W of the water flow baffle 1 is greater than or equal to the diameter d of the water injection port. Further, the water flow baffle 1 is in the shape of a flat plate, a curved plate or a prismatic plate. Compared with the flat plate, the fluid is gently shunted when the fluid flows through the curved plate or the prismatic plate and thus has a better anti-overflow effect. Hence, the water flow baffle 1 is in the shape of a curved plate or a prismatic plate. Preferably, the water flow baffle is in the shape of a curved plate to match the water injection port.

Further, the water flow baffle 1 and the water injection end 3 of the water injection hose 4 are in an integrated structure. Preferably, the water flow baffle 1 is a curved plate that extends from the inner wall of the water injection end 3 to the outside of the hose and matches the water injection port. Further preferably, the inner surface of the water flow baffle 1 and the inner surface of the water injection end 3 have a smooth transition. A pipe clamp is fixed between the water injection end of the water injection hose and the outer drum. Further, the water flow baffle 1 and the water injection end 3 of the water injection hose 4 are in a split structure. Preferably, the water flow baffle 1 is provided with an integrated connecting pipe 7, and is fixed with the water injection end 3 by threading the connecting pipe insertion 7 into the water injection end 3. Preferably, the outer drum 5 is clamped between the water flow baffle 1 and the water injection end 3. The water flow baffle 1 is a curved plate extending from the inner wall of the connecting pipe 7 and matching the connecting pipe 7, and the inner surface of the water flow baffle 1 and that of the connecting pipe 7 have a smooth transition.

Further, the anti-overflow device also includes a blocking rib 2, and the blocking rib 2 is arranged on the inner side of the water injection port and close to the outer drum 5. And the blocking rib 2 is opposite to the water flow baffle 1. Further, the blocking rib 2 is set at an angle to the cross section of the water injection port and inclined toward the outer drum 5. Further, the angle between the blocking rib 2 and the water injection direction of the water injection port is between 30°-90°. Further, the ratio h/d of the vertical chord height h from the blocking rib 2 to the water injection port to the diameter d of the water injection port is greater than 0 and less than 1, preferably between 0.25 and 0.75. As shown in FIG. 3, in the present embodiment, the corrugated part of the water injection hose 4 also has a certain anti-overflow effect, and the anti-overflow effect is related to the size and number of folds of the water injection hose 4.

The smaller the diameter of the water injection hose 4 is, the better the anti-overflow effect played by the corrugated part of the water injection hose 4 is. At the same time, the smaller the diameter of the water injection hose 4 is, the smaller the normal inlet flow is, the longer the inlet time is, and the longer the laundry time is. On the contrary, the larger the diameter of the water injection hose 4 is, the worse the anti-overflow effect played by the corrugated part of the water injection hose 4 is. At the same time, the larger the diameter of the water injection hose 4 is, the greater the normal inlet flow will be, the shorter the inlet time will be, and the shorter the laundry time will be. Affected by various factors, the diameter of the water injection hose can be changed in a limited range, and correspondingly the overflow effect played by the water injection hose is also limited.

The folds in the corrugated part of the water injection hose 4 have the effect of buffering to prevent the drum from pulling the sink when it vibrates violently. The more folds in the corrugated part of the water injection hose 4 are, the greater the crushing stroke is, otherwise, the smaller the crushing stroke is. However, limited by space and molding technology, the change of the folds in the corrugated part of the water injection hose 4 is not obvious, and correspondingly the change of the buffering effect is not very obvious.

Described above is only part of the better embodiments of the present disclosure, and is not the limitation to the present disclosure in any form. Although the present disclosure has already disclosed its better embodiments as mentioned above, they are not used to limit the present disclosure. Any technician who is familiar with the present disclosure, within the scope of the technical solution of the present disclosure, can make a little change or modify the present disclosure to an equivalent embodiment with the equivalent change. However, any technical content that is not beyond the technical solution of the present disclosure, any simple modification, equivalent change and modification made to the aforesaid embodiment according to the technical substance of the present disclosure, are within the technical solution of the present disclosure.

The invention claimed is:

1. An anti-overflow device, comprising:

a water flow baffle, wherein the water flow baffle is arranged to be installed at a water injection port and to extend along a direction from an outer drum to an inner drum, and the water flow baffle is configured to block water flow to run back into the water injection port with high speed operation of the inner drum; and a blocking rib arranged on an inner side of the water injection port and close to the outer drum, wherein the blocking rib is configured to be set at an angle to a cross section of the water injection port and inclined toward the outer drum.

2. The anti-overflow device according to claim 1, wherein a ratio L/H of a length L of the water flow baffle inserted into the outer drum and a distance H between the inner drum and the outer drum at the water injection port is greater than 0 and less than 1.

3. The anti-overflow device according to claim 1, wherein the water flow baffle is in the shape of a curved plate or a prismatic plate.

4. The anti-overflow device according to claim 1, wherein the water flow baffle and a water injection end of a water injection hose are in an integrated structure.

5. The anti-overflow device according to claim 1, wherein the water flow baffle and a water injection end of a water injection hose are in a split structure.

6. The anti-overflow device according to claim 1, wherein the angle between the blocking rib and a water injection direction of the water injection port is between 30°-90°.

7. The anti-overflow device according to claim 1, wherein a ratio h/d of a vertical chord height h from the blocking rib to the water injection port to a diameter d of the water injection port is greater than 0 and less than 1.

8. The anti-overflow device according to claim 2, wherein the ratio L/H is between 0.3 and 0.85.

9. The anti-overflow device according to claim 3, wherein the water flow baffle is in the shape of a curved plate to match a shape of the water injection port.

10. The anti-overflow device according to claim 4, wherein the water flow baffle is a curved plate that extends from an inner wall of the water injection end to an outside of the water injection hose and matches the water injection port.

11. The anti-overflow device according to claim 4, wherein an inner surface of the water flow baffle smoothly transitions to an inner surface of the water injection end.

12. The anti-overflow device according to claim 5, comprising:

a connecting pipe wherein the water flow baffle is integrated with the connecting pipe, and is fixed on the water injection end by threading the connecting pipe to the water injection end.

13. The anti-overflow device according to claim 7, wherein the ratio h/d is between 0.25 and 0.75.

14. A drum washing machine, comprising:

a drum water injection port, an inner drum;

an outer drum;

a water flow baffle, wherein the water flow baffle is arranged to be installed at the water injection port and to extend along a direction from the outer drum to the inner drum, and the water flow baffle is configured to block water flow to run back into the water injection port with high speed operation of the inner drum; and a blocking rib arranged on an inner side of the water injection port and close to the outer drum, wherein the blocking rib is set at an angle to a cross section of the water injection port and inclined toward the outer drum.

15. The drum washing machine according to claim 14, wherein the water flow baffle and the water injection end of the water injection hose are in a split structure, and the outer drum is clamped between the water flow baffle and the water injection end.

* * * * *